US012220646B1

(12) United States Patent
Zhuang

(10) Patent No.: US 12,220,646 B1
(45) Date of Patent: Feb. 11, 2025

(54) FOLDING CONNECT FOUR

(71) Applicant: Penghang Zhuang, Zhejiang (CN)

(72) Inventor: Penghang Zhuang, Zhejiang (CN)

( * ) Notice: Subject to any disclaimer, the term of this patent is extended or adjusted under 35 U.S.C. 154(b) by 0 days.

(21) Appl. No.: 18/675,222

(22) Filed: May 28, 2024

(51) Int. Cl.
*A63F 3/00* (2006.01)

(52) U.S. Cl.
CPC ..... *A63F 3/00006* (2013.01); *A63F 3/00261* (2013.01); *A63F 2003/0041* (2013.01)

(58) Field of Classification Search
CPC ..... A63F 3/00006; A63F 3/00261; A63F 2003/0041; A63F 3/00533
See application file for complete search history.

(56) References Cited

U.S. PATENT DOCUMENTS 4,131,283 A * 12/1978 Havlik ..... A63F 3/02 273/287
4,645,209 A * 2/1987 Goulter ..... A63F 3/02 273/287
7,810,814 B1 * 10/2010 Chapman ..... A63F 3/00094 273/287

OTHER PUBLICATIONS

Merlin article titled "DIY: create a wooden game for children" by Leroy Merlin, published Jan. 3, 2020 at https://www.leroymerlin.fr/tutos/tutos-creatifs-et-diy/diy-creer-un-jeu-en-bois-pour-enfants.html?utm_source=pinterest&utm_medium=social (Year: 2020).*
"NEW giant connect 4 game set" YouTube video uploaded on Jun. 24, 22 by sporting goods factoy—xinxing at https://www.youtube.com/watch?v=aAjRiH6KoRg) (Year: 2022).*

* cited by examiner

*Primary Examiner* — Michael D Dennis
(74) *Attorney, Agent, or Firm* — Hawaii Patent Services; Nathaniel K. Fedde; Kenton N. Fedde

(57) ABSTRACT

The present invention discloses a folding Four In A Row, including a game board, where chess piece channels opened in bottoms and tops are formed in the game board; and a storage trough located right below the chess piece channels, where a chess piece tray capable of being folded is rotationally connected in the storage trough; in a case that the chess piece tray rotates in a folded state, the chess piece tray is located in the storage trough; a sealing member for sealing the bottoms of the chess piece channels is movably mounted between the chess piece tray and the chess piece channels; in a case that the sealing member releases sealing to the chess piece channels, the chess piece channels are connected to the storage trough; and supporting legs are detachably connected to a bottom of the game board, and a suspension member is arranged on the game board.

15 Claims, 8 Drawing Sheets

A

FOLDING CONNECT FOUR

TECHNICAL FIELD

The present invention relates to the technical field of Connect Four®, and particularly relates to a folding Connect Four®.

BACKGROUND

A Connect Four®, also known as Four In A Row, is a puzzle board game for two-man game.

An existing American patent with publication number U.S. Pat. No. 7,810,814B1 discloses a "Strategic pattern building board game with ejecting feature". In the patent, there is no chess piece tray for storing chess pieces. During the game, it is inconvenient to store and place the chess pieces.

However, even if a part of existing Connect Four® has the chess piece tray for storing chess pieces, the chess piece tray is usually fixedly connected to a game board and cannot be folded. Therefore, when the Connect Four® is transported or stored, it will occupied huge space. Moreover, the existing Connect Four® only can be vertically placed on the ground or on a platform, with a certain limitation.

To sum up, the chess piece tray of the Connect Four® in the prior art cannot be folded, and the Connect Four® will occupy huge space during transportation and cannot be used, transported or stored in a suspended manner.

Based on the above problem, it is necessary to provide a novel Four in a Row. When the novel Four in a Row is not used, the chess piece tray can be folded, and the game board can be suspended, so that the volume is reduced and the occupied area is reduced; and when the Four in a Row is used, the chess piece tray can be turned to a horizontal state and the chess pieces are stored, and moreover, it can also be suspended for use.

SUMMARY

The terms "invention," "the invention," "this invention" and "the present invention" used in this patent are intended to refer broadly to all of the subject matter of this patent and the patent claims below: Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below: This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention provides a folding Four in a Row to solve the problem that the chess piece tray of the Four in a Row in the background art cannot be folded, and the Four in a Row will occupy huge space during transportation and cannot be used, transported or stored in a suspended manner.

In order to achieve the above object, the present invention adopts the following technical solution:

a folding Four in a Row includes a game board, where chess piece channels opened in bottoms and tops are formed in the game board; and a storage trough located right below the chess piece channels, where a chess piece tray capable of being folded is rotationally connected in the storage trough:

in a case that the chess piece tray rotates in a folded state, the chess piece tray is located in the storage trough; and supporting legs are detachably connected to a bottom of the game board, and a suspension member is arranged on the game board.

a folding Four in a Row includes a game board, where chess piece channels opened in bottoms and tops are formed in the game board; and a storage trough located right below the chess piece channels, where a chess piece tray capable of being folded is rotationally connected in the storage trough:

a sealing member for sealing the bottoms of the chess piece channels is movably mounted between the chess piece tray and the chess piece channels:

supporting legs are detachably connected to a bottom of the game board, and a suspension member is arranged on the game board; and one limiting mechanism is at least arranged on one side between the chess piece tray and the storage trough; and the limiting mechanism includes a first connecting rod and a second connecting rod, where the first connecting rod is rotationally connected to an inner side surface of the storage trough, the second connecting rod is rotationally connected to an outer side surface of the storage trough, and ends of the first connecting rod and the second connecting rod close to each other are rotationally connected.

A method for storing a Four in a Row includes use of a folding Four in a Row, where the folding Four in a Row includes a game board, chess piece channels opened in bottoms and tops are formed in the game board; and a storage trough located right below the chess piece channels, where a chess piece tray capable of being folded is rotationally connected in the storage trough: a sealing member for sealing the bottoms of the chess piece channels is movably mounted between the chess piece tray and the chess piece channels: supporting legs are detachably connected to both ends of the bottom of the game board, a suspension member is arranged on the game board: the suspension member comprises at least one hanging ring, and a slot located above the chess piece tray is formed in the storage trough: the method includes the following steps:

S1: taking out chess pieces from the chess piece channels, and storing the chess pieces:

S2: turning the chess piece tray to make the chess piece tray be in a vertical state and located in the storage trough:

S3: in a case that the chess piece tray is stored, locking the chess piece tray in the storage trough by using a locking mechanism:

S4: pulling out the supporting legs form the bottom of the game board and storing the supporting legs; and S5: hanging the hanging ring on a hook, so as to hang, transport or store the game board.

A folding Four in a Row, comprising a game board, wherein game piece channels opened in bottoms and tops are formed in the game board; and a storage trough located right below the game piece channels, wherein the storage trough comprises a game piece tray rotationally connected in the storage trough such that the game piece tray can be folded: wherein: in a case that the game piece tray rotates in a folded state, the game piece tray is located in the storage trough: supporting legs are detachably connected to a bottom of the game board, and a suspension member is arranged on the game board: the game board is provided with a locking mechanism: the locking mechanism comprises a rotating bar and a connector: the rotating bar is rotationally mounted on a surface of the game board; and the connector is mounted at the bottom of the game piece tray.

A folding Four in a Row; comprising a game board, wherein game piece channels opened in bottoms and tops are formed in the game board; and a storage trough located right below the game piece channels, wherein a game piece tray capable of being folded is rotationally connected in the storage trough: a sealing member for sealing the bottoms of the game piece channels is movably mounted between the game piece tray and the game piece channels: supporting legs are detachably connected to a bottom of the game board, and a suspension member is arranged on the game board; and a limiting mechanism is at least arranged on one side between the game piece tray and the storage trough; and the limiting mechanism comprises a first connecting rod and a second connecting rod, wherein the first connecting rod is rotationally connected to an inner side surface of the storage trough, the second connecting rod is rotationally connected to an outer side surface of the storage trough, and ends of the first connecting rod and the second connecting rod close to each other are rotationally connected.

A method for storing a Four in a Row; comprising use of a folding Four in a Row; wherein the folding Four in a Row comprises a game board, game piece channels opened in bottoms and tops are formed in the game board; and a storage trough located right below the game piece channels, wherein a game piece tray capable of being folded is rotationally connected in the storage trough: a sealing member for sealing the bottoms of the game piece channels is movably mounted between the game piece tray and the game piece channels: supporting legs are detachably connected to both ends of the bottom of the game board, a suspension member is arranged on the game board: the suspension member comprises at least one hanging ring, and a slot located above the game piece tray is formed in the storage trough, the game board is provided with a locking mechanism: the locking mechanism comprises a rotating bar and a connector, a plug is arranged at an outer end of the rotating bar, and a plug hole formed corresponding to the plug is formed in the connector; the method comprises the following steps:

S1: taking out game pieces form the game piece channels, and storing the game pieces:

S2: turning the game piece tray to make the game piece tray be in a vertical state and located in the storage trough:

S3: in a case that the game piece tray is stored, locking the game piece tray in the storage trough by using a locking mechanism:

S4: pulling out the supporting legs form the bottom of the game board and storing the supporting legs; and S5: hanging the at least one hanging ring on a hook, so as to hang, transport or store the game board.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
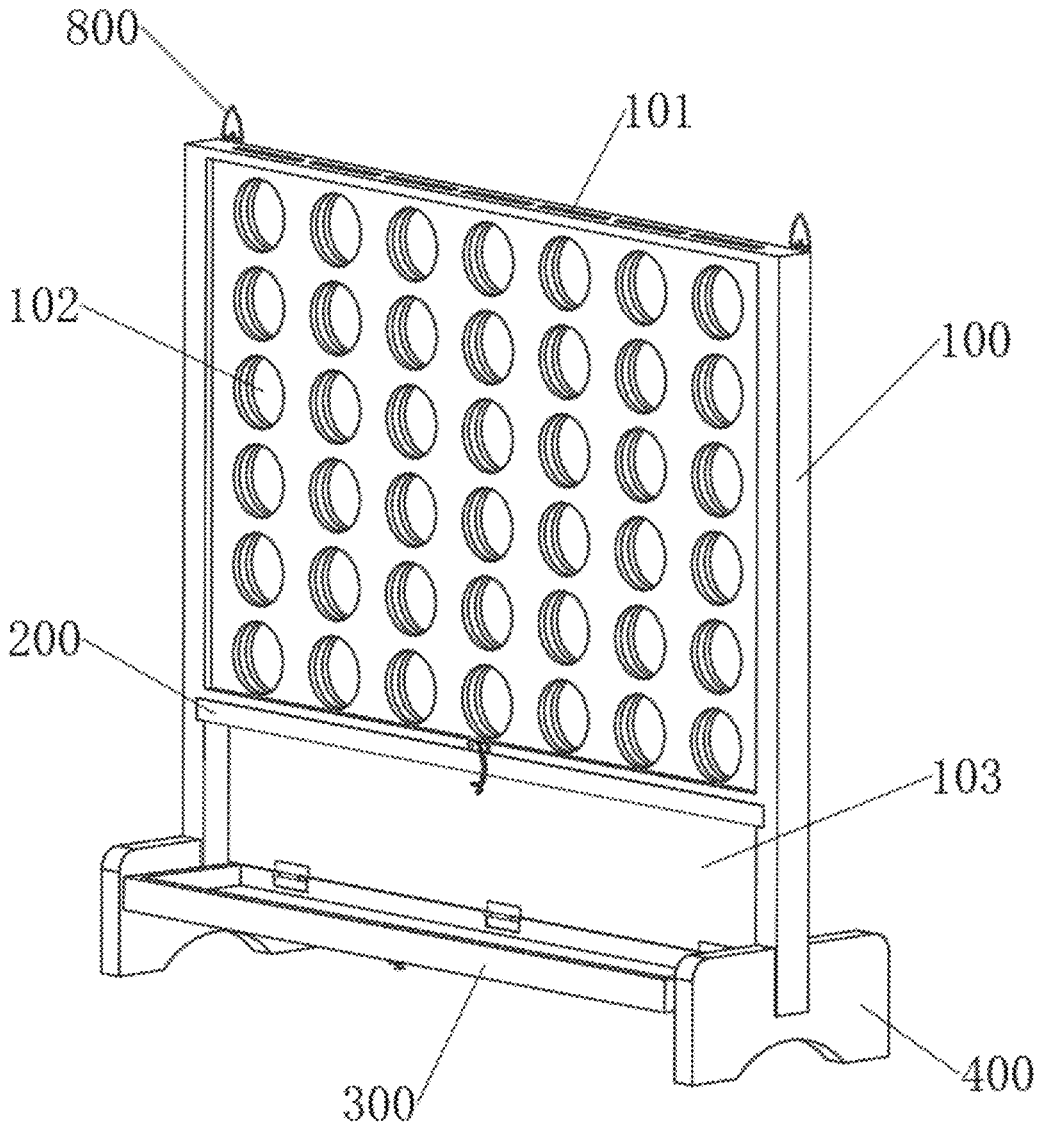
FIG. 1 is a structural schematic diagram of the embodiment I of the present invention.
Figure 2:
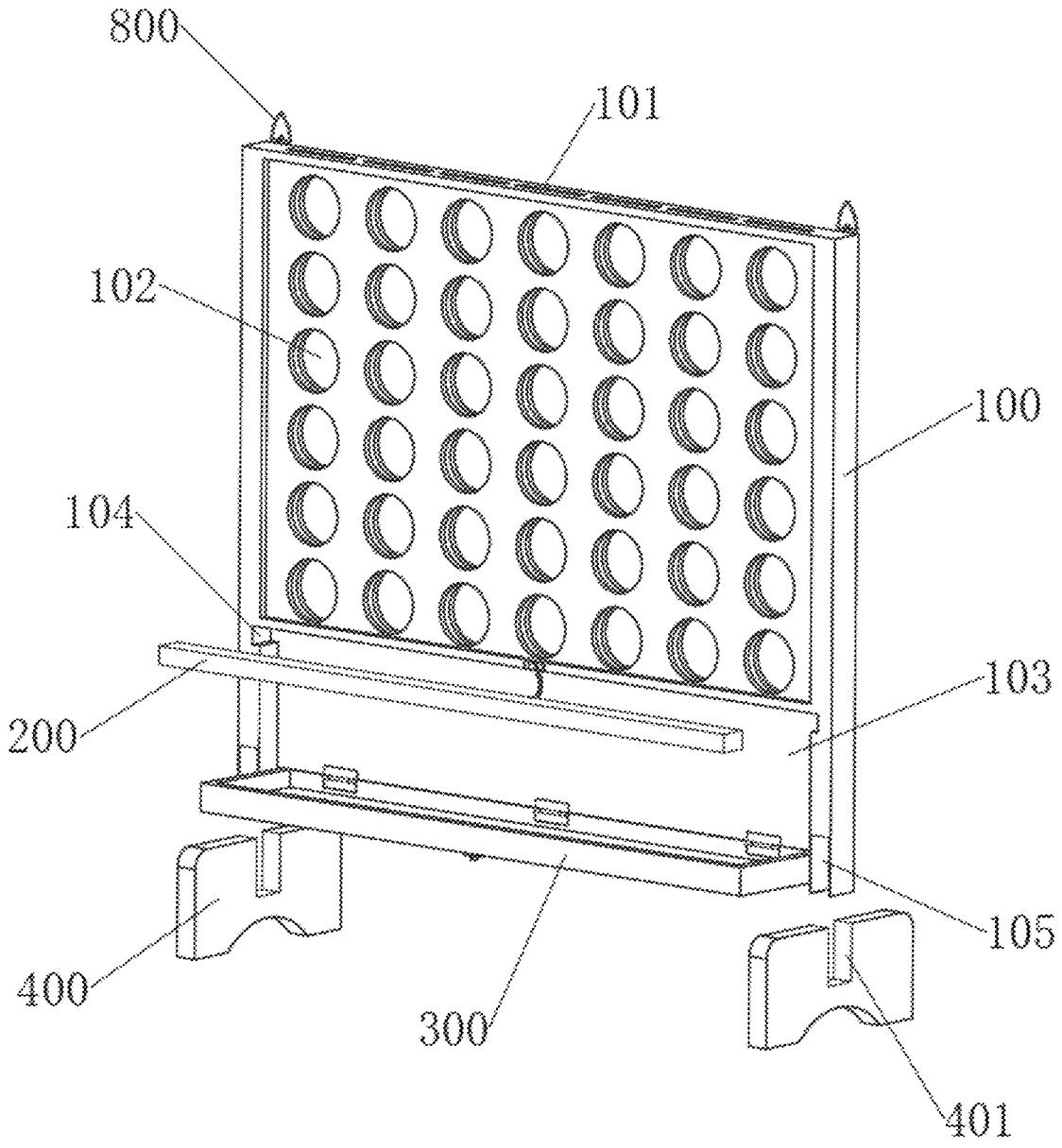
FIG. 2 is an exploded view of the embodiment I of the present invention.
Figure 3:
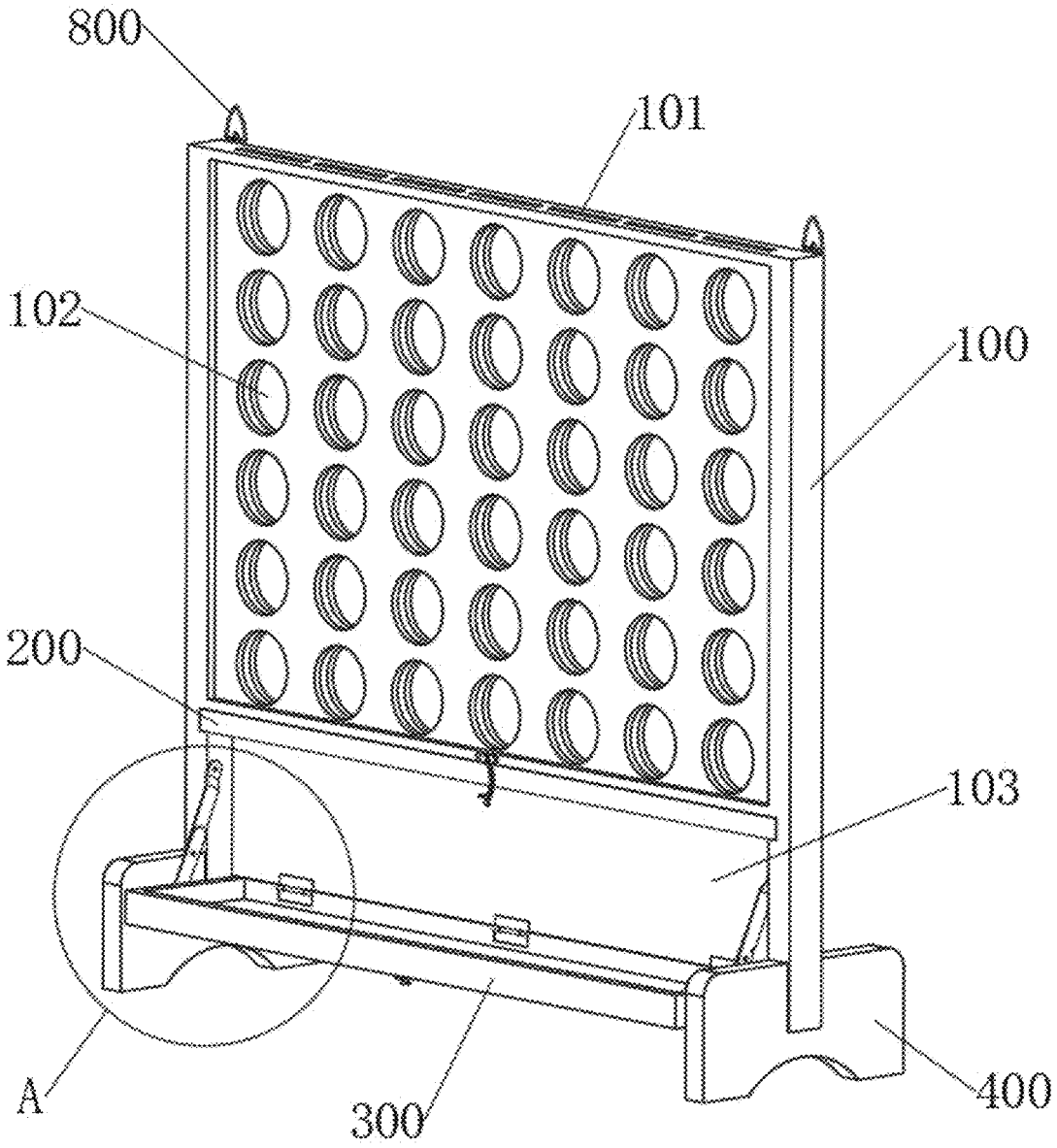
FIG. 3 is a structural schematic diagram of an embodiment II of the present invention.

In the drawings: 100, game board; 101, chess piece channel; 102, chess piece show hole; 103, storage trough; 104, slot; 105, first groove; 200, sealing member; 300, chess piece tray; 400, supporting leg; 401, second groove; 500, limiting mechanism; 501, first connecting rod; 502, second connecting rod; 600, rotating bar; 601, plug; 700, connector; 701, plug hole; and 800, hanging ring.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a." "an," and "the" are intended to include the plural forms as well, unless the context clearly indicates other.

Embodiment I

Referring to FIGS. 1, 2, and 6-8, the present invention provides a folding Four in a Row, including a game board 100, where chess piece channels 101 opened in bottoms and tops are formed in the game board 100; and a storage trough 103 located right below the chess piece channels 101, where a chess piece tray 300 capable of being folded is rotationally connected in the storage trough 103: in a case that the chess piece tray 300 rotates in a folded state, the chess piece tray 300 is located in the storage trough 103: a sealing member 200 for sealing the bottoms of the chess piece channels 101 is movably mounted between the chess piece tray 300 and the chess piece channels 101: in a case that the sealing member 200 releases sealing to the chess piece channels 101, the chess piece channels 101 are connected to the storage trough 103; and supporting legs 400 are detachably connected to a bottom of the game board 100, and a suspension member is arranged on the game board 100:

a plurality of chess piece show holes 102 are formed in at least one side surface of each of the chess piece channels 101, and the chess piece tray 300 is rotationally connected to the storage trough 103 through a 90-degree hinge, so that the chess piece tray 300 can turn up and down at 90 degrees, and therefore, the chess piece tray 300 can be turned to a vertical state and a horizontal state:

thus, during use of the Four in a Row; the game board 100 can be placed on the ground or a platform through the supporting legs 400, the chess pieces fall into the chess piece channels 101 through the openings in the tops of the chess piece channels 101, and the sealing member 200 seals the bottoms of the chess piece channels 101 to prevent the chess pieces from dropping out from the chess piece channels 101, and the positions of the chess pieces can be observed through chess piece show holes 102; and in a case that the sealing member 200 is separated from the slot 104, the chess piece channels 101 are connected to the storage trough 103: therefore, if it is needed to take out the chess pieces from the chess piece channels 101, it is only needed to pull out the sealing member 200 from the slot 104 and then the sealing member 200 releases sealing of the bottoms of the chess piece channels 101, then the chess pieces will fall from the bottoms of the chess piece channels 101, and the falling chess pieces will fall onto the chess piece tray 300 which is horizontally placed, so that the chess piece tray 300 can collect and store the chess pieces.

Figure 7:
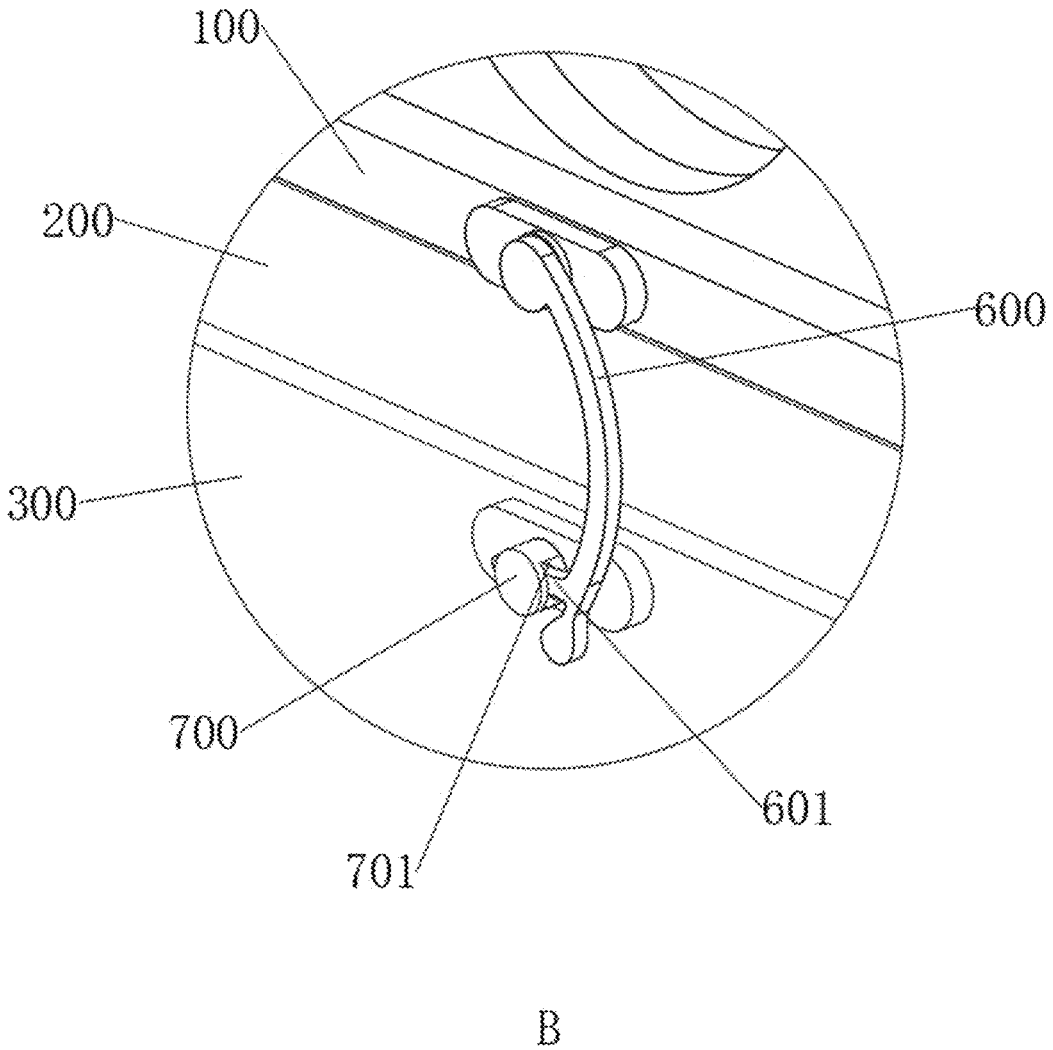
FIG. 7 is a partially enlarged schematic diagram of B in FIG. 6.
Figure 8:
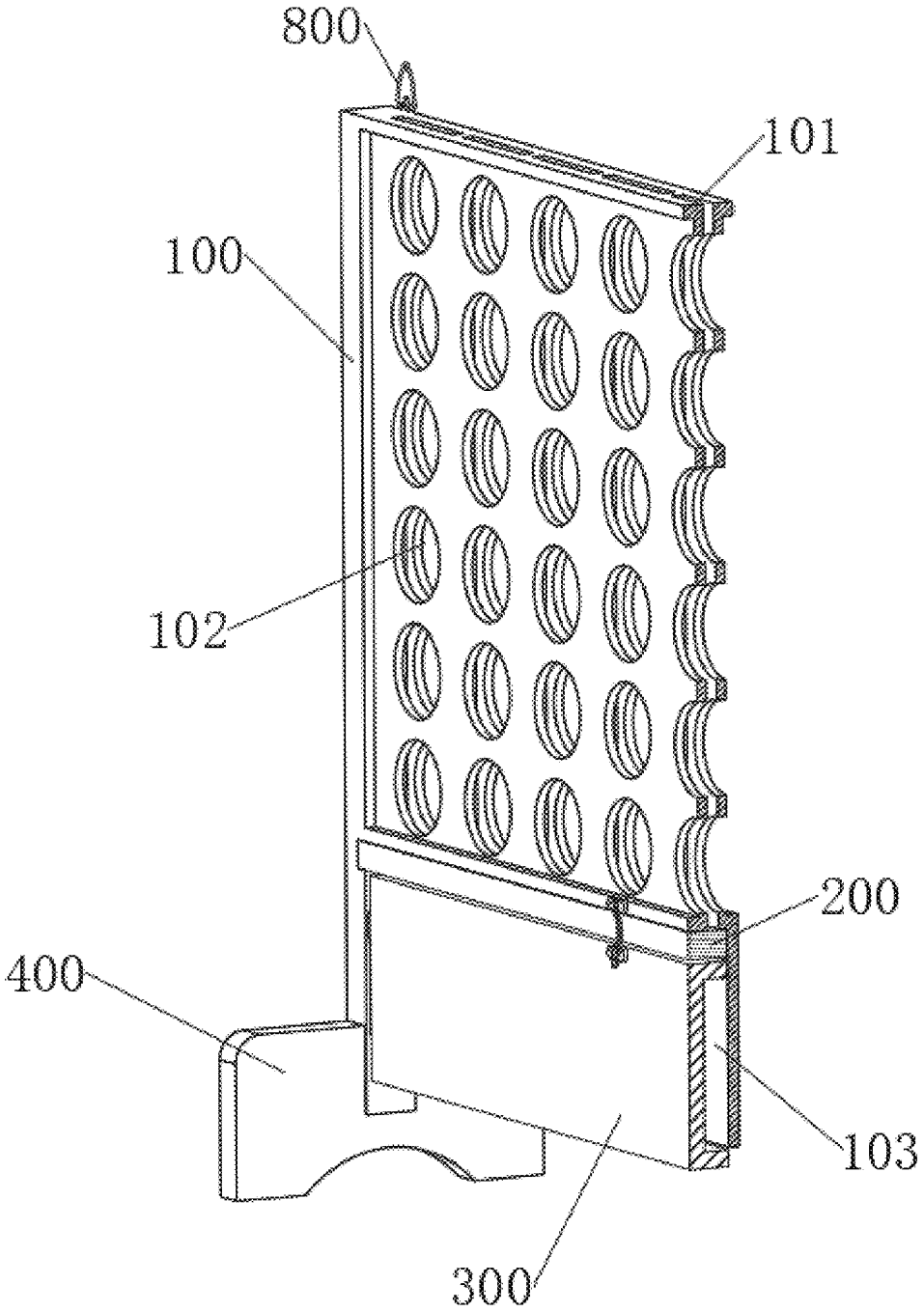
FIG. 8 is a sectional view of FIG. 6 in the present invention.

According to the above, in a case that the chess piece tray 300 rotates to the vertical state, the chess piece tray 300 is parallel to the game board 100 and is located in the storage trough 103: the game board 100 is provided with a locking mechanism which includes a rotating bar 600 and a connector 700, where the rotating bar 600 is rotationally mounted on a surface of the game board 100, the connector 700 is mounted at a bottom of the chess piece tray 300, a plug 601 is arranged at an outer end of the rotating bar 600, and a plug hole 701 formed corresponding to the plug 601 is formed in the connector 700; and in a case that the chess piece tray 300 is located in the storage trough 103, the plug 601 is inserted into the plug hole 701:

in a case that the Four in a Row is not used, the chess pieces are taken out from the chess piece tray 300 and stored, and then the chess piece tray 300 is turned upward to the vertical state, so that the chess piece tray 300 can be folded into the storage trough 103 for storage: the back surface of the storage trough 103 is of a closed structure, so that in a case that the chess piece tray 300 is stored in the storage trough 103, the chess piece tray 300 can close the storage trough 103: as shown in FIG. 8, some articles related to the Four in a Row can be placed between the storage trough 103 and the chess piece tray 300, for example, chess pieces:

in a case that the chess piece tray 300 is folded and stored, the rotating bar 600 is pushed to rotate toward the connector 700, and then the plug 601 can be inserted into the plug hole 701, so that the chess piece tray 300 can be fixed in the storage trough 103:

moreover, the rotating bar 600 in the locking mechanism can be mounted above the sealing member 200, so that in a case that the locking mechanism fixes the chess piece tray 300 in the storage trough 103, the rotating bar 600 will block in front of the sealing member 200; as shown in FIG. 7, in this case, the rotating bar 600 will also limit the front of the sealing member 200, so that the sealing member 200 is unlikely to fall off from the slot 104.

a second groove 401 is formed in a side, facing the game board 100 of each of the supporting legs 400: a first groove 105 formed corresponding to the second groove 401 is formed in a bottom of the supporting leg 400, and the second groove 401 and the first groove 105 are plugged with each other; and the suspension member includes at least one hanging ring 800, and the hanging ring 800 is mounted outside the game board:

as the first groove 105 and the second groove 401 cooperate with each other, the supporting leg 400 and the game board 100 can be detached, so that in a case that the Four in a Row is transported and stored, the supporting leg 400 can be pulled out from the bottom of the game board 100 and is placed in a needed placed for storage: thus, the packaging volume of the Four in a Row can be reduced, which facilitates storage and transportation; and by arranging the hanging ring 800, the game board 100 is suspended at a hook, so that the Four in a Row can be transported in a suspended manner:

moreover, in a case that the Four in a Row is used, the supporting leg 400 can also be detached, the game board 100 is then suspended in a needed place such as a wall through the hanging ring 800, so that the Four in a Row can be used in a suspended manner, and therefore, the occupied area of the Four in a Row is reduced, and the space is saved:

furthermore, the suspension member is not limited to the form of the hanging ring 800, and in other implementations, the suspension member can also be in any form capable of achieving suspension such as a hook and a rope.

In other implementations, the drawings are not shown. The depth of the storage trough 103 and the depth of the chess piece tray 300 can be set larger, thus, in a case that the Four in a Row is folded and stored, the chess pieces and the supporting leg 400 can also be placed in the chess piece tray 300 for storage, so that the chess pieces and the supporting leg 400 are stored more conveniently.

To sum up, by arranging the chess piece tray 300 capable of being turned upward and folded, in a case that the Four in a Row is used, the chess piece tray 300 can collect and store the chess pieces, and in a case that the Four in a Row is not used, the chess piece tray 300 can be folded and stored, so that the volume of the Four in a Row is reduced, which facilitates transportation and storage of the Four in a Row:

by arranging the detachable supporting legs 400 and the hanging ring 800, in a case that the Four in a Row is transported and stored, the supporting leg 400 can be detached, so that the volume of the Four in a Row is further reduced: the hanging ring 800 is further used to place the game board 100 in a suspended manner, so that the occupied area of the Four in a Row transported and stored is reduced; and moreover, in a case that the Four in a Row is used, the game board 100 can also be placed in a suspended manner, so that the applicability of the Four in a Row is improved.

Embodiment II

Referring to FIGS. 3-8, the present invention provides a folding Four in a Row;

including a game board 100, where chess piece channels 101 opened in bottoms and tops are formed in the game board 100; and a storage trough 103 located right below the chess piece channels 101, where a chess piece tray 300 capable of being folded is rotationally connected in the storage trough 103: a sealing member 200 for sealing the bottoms of the chess piece channels 101 is movably mounted between the chess piece tray 300 and the chess piece channels 101; and supporting legs 400 are detachably connected to a bottom of the game board 100, and a suspension member is arranged on the game board 100.

Figure 4:
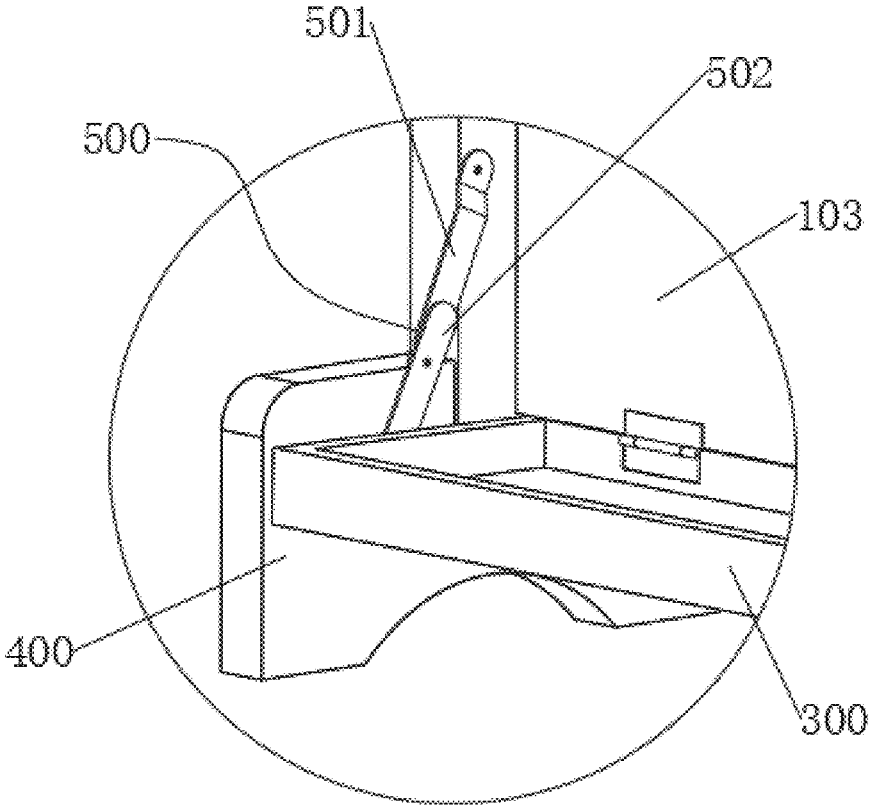
FIG. 4 is a partially enlarged schematic diagram of A in FIG. 3.
Figure 5:
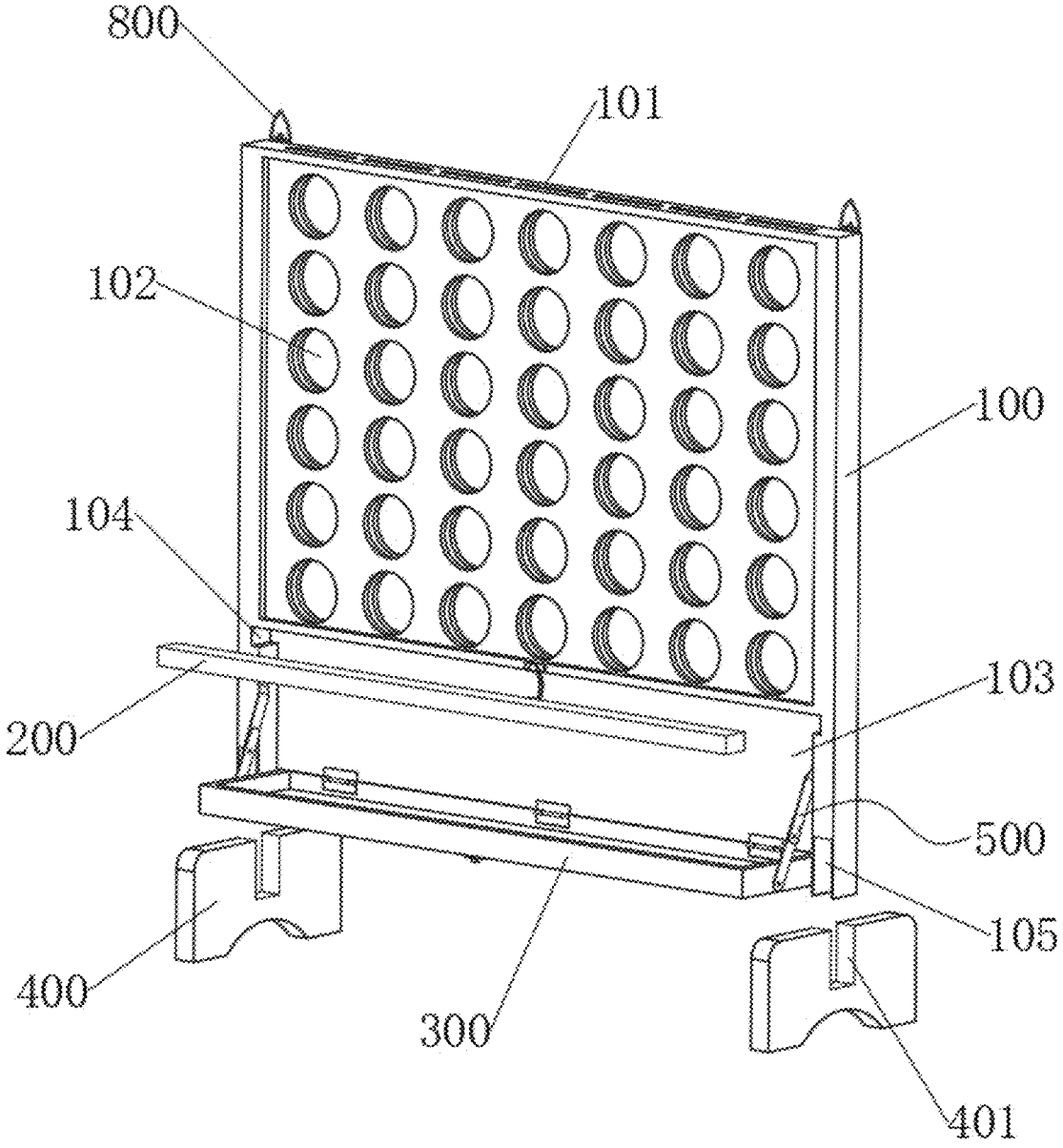
FIG. 5 is an exploded view of the embodiment II of the present invention.
Figure 6:
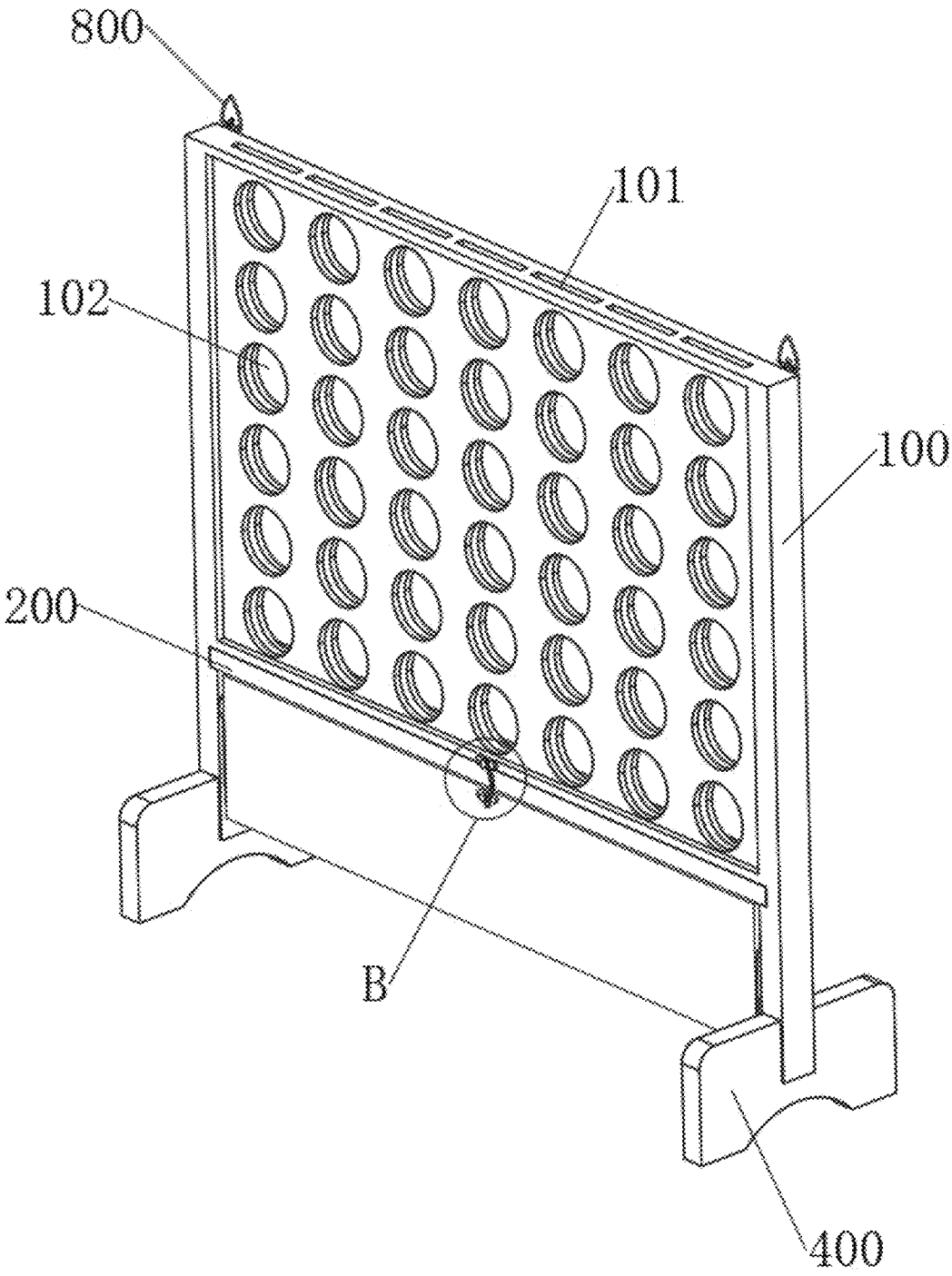
FIG. 6 is a state diagram of the turned and folded chess piece tray of the present invention.

Differences between the embodiment I and the embodiment II are as follows:

one limiting mechanism 500 is at least arranged on one side between the chess piece tray 300 and the storage trough 103; and the limiting mechanism 500 includes a first connecting rod 501 and a second connecting rod 502, where the first connecting rod 501 is rotationally connected to an inner side surface of the storage trough 103, the second connecting rod 502 is rotationally connected to an outer side surface of the storage trough 103, and ends of the first connecting rod 501 and the second connecting rod 502 close to each other are rotationally connected:

in a case that the rotating angle at the rotating connection between the chess piece tray 300 and the storage trough 103 cannot be limited, the limiting mechanism 500 can limit the rotating angle of the chess piece tray 300 after the chess piece tray 300 is turned, so that in a case that the chess piece tray 300 is turned to the horizontal state, the first connecting rod 501 and the second connecting rod 502 will be straightened, as shown in FIG. 4, so that the chess piece tray 300 cannot rotate downward continuously and is kept in the current horizontal state: and in a case that the chess piece tray 300 is folded and stored in the storage trough 103, the first connecting rod 501 and the second connecting rod 502 can also be folded and stored in the storage trough 103.

The present invention further provides a method for storing a Four in a Row, which uses a folding Four in a Row, where the folding Four in a Row includes a game board 100, chess piece channels 101 opened in bottoms and tops are formed in the game board 100; and a storage trough 103 located right below the chess piece channels 101, where a chess piece tray 300 capable of being folded is rotationally connected in the storage trough 103: a sealing member 200 for sealing the bottoms of the chess piece channels 101 is movably mounted between the chess piece tray 300 and the chess piece channels 101: supporting legs 400 are detachably connected to both ends of the bottom of the game board 100, a suspension member is arranged at the top of on the game board 100, and a slot 104 located above the chess piece tray 300 is formed in the storage trough 103: the method includes the following steps:

S1: chess pieces are taken out form the chess piece channels 101, and the chess pieces are stored: in a case that the chess pieces are taken out, the sealing member 200 is pulled out first from the slot 104, then the bottoms of the chess piece channels 101 are opened, the chess pieces fall into the chess piece tray 300 to be collected, and then the chess pieces are taken away and stored.

S2: the chess piece tray 300 is turned to make the chess piece tray 300 be in a vertical state and located in the storage trough 103; and in a case that the chess piece tray 300 is stored in the storage trough 103, the sealing member 200 is re-inserted into the slot 104 for storage.

S3: in a case that the chess piece tray 300 is stored, the chess piece tray 300 is locked in the storage trough 103 by using the locking mechanism: in a case that the chess piece tray 300 is locked, it is pushed to rotate toward the connector 700, the rotating bar 600 that rotates inserts the plug 601 into the plug hole 701 of the connector 700, so that the chess piece tray 300 is stored in the storage trough 103; and in a case that the chess piece tray 300 is locked, the rotating bar 600 is located in front of the sealing member 200, so that the sealing member 200 is also limited.

S4: the supporting legs 400 are pulled out form the bottom of the game board 100 and the supporting legs are stored.

S5: the hanging ring 800 is hung on a hook, so as to hang, transport or store the game board 100.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or"

is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A folding four in a row, comprising a game board, wherein game piece channels opened in bottoms and tops are formed in the game board; and a storage trough located right below the game piece channels, wherein the storage trough comprises a game piece tray rotationally connected in the storage trough such that the game piece tray can be folded;

wherein:

in a case that the game piece tray rotates in a folded state, the game piece tray is located in the storage trough;

supporting legs are detachably connected to a bottom of the game board, and a suspension member is arranged on the game board;

the game board is provided with a locking mechanism;

the locking mechanism comprises a rotating bar and a connector;

the rotating bar is rotationally mounted on a surface of the game board; and the connector is mounted at the bottom of the game piece tray.

2. The folding four in a row according to claim 1, wherein a plurality of game piece show holes are formed in at least one side surface of each of the game piece channels.

3. The folding four in a row according to claim 1, wherein a sealing member is arranged at the bottom of each of the game piece channels and is movably mounted between the game piece tray and the game board for sealing the bottom of the game piece channels.

4. The folding four in a row according to claim 3, wherein in a case that the sealing member releases sealing to the game piece channels, the game piece channels are connected to the storage trough.

5. The folding four in a row according to claim 1, wherein the suspension member comprises at least one hanging ring, and the at least one hanging ring is mounted outside the game board.

6. The folding four in a row according to claim 1, wherein a slot located above the game piece tray is formed in the storage trough, and a sealing member is inserted into the slot.

7. The folding four in a row according to claim 1, wherein a plug is arranged at an outer end of the rotating bar, and a plug hole formed corresponding to the plug is formed in the connector.

8. The folding four in a row according to claim 7, wherein in a case that the game piece tray is located in the storage trough, the plug is inserted into the plug hole.

9. The folding four in a row according to claim 1, wherein a second groove is formed in a side, facing the game board, of each of the supporting legs; a first groove formed corresponding to the second groove is formed in a bottom of each of the supporting legs; and the second groove and the first groove are plugged with each other.

10. A folding four in a row, comprising a game board, wherein game piece channels opened in bottoms and tops are formed in the game board; and a storage trough located right below the game piece channels, wherein a game piece tray capable of being folded is rotationally connected in the storage trough;

a sealing member for sealing the bottoms of the game piece channels is movably mounted between the game piece tray and the game piece channels;

supporting legs are detachably connected to a bottom of the game board, and a suspension member is arranged on the game board; and a limiting mechanism is at least arranged on one side between the game piece tray and the storage trough; and the limiting mechanism comprises a first connecting rod and a second connecting rod, wherein the first connecting rod is rotationally connected to an inner side surface of the storage trough, the second connecting rod is rotationally connected to an outer side surface of the storage trough, and ends of the first connecting rod and the second connecting rod close to each other are rotationally connected.

11. A method for storing a four in a row, comprising use of a folding four in a row, wherein the folding four in a row comprises a game board, game piece channels opened in bottoms and tops are formed in the game board; and a storage trough located right below the game piece channels, wherein a game piece tray capable of being folded is rotationally connected in the storage trough; a sealing member for sealing the bottoms of the game piece channels is movably mounted between the game piece tray and the game piece channels; supporting legs are detachably connected to both ends of the bottom of the game board, a suspension member is arranged on the game board; the suspension member comprises at least one hanging ring, and a slot located above the game piece tray is formed in the storage trough, the game board is provided with a locking mechanism; the locking mechanism comprises a rotating bar and a connector, a plug is arranged at an outer end of the rotating bar, and a plug hole formed corresponding to the plug is formed in the connector; the method comprises the following steps:

S1: taking out game pieces form the game piece channels, and storing the game pieces;

S2: turning the game piece tray to make the game piece tray be in a vertical state and located in the storage trough;

S3: in a case that the game piece tray is stored, locking the game piece tray in the storage trough by using a locking mechanism;

S4: pulling out the supporting legs form the bottom of the game board and storing the supporting legs; and S5: hanging the at least one hanging ring on a hook, so as to hang, transport or store the game board.

12. The method for storing a four in a row according to claim 11, wherein in a case that the game pieces are taken out, the sealing member is pulled out from the slot first, then the bottoms of the game piece channels are opened, the game pieces fall into the game piece tray to be collected, and then the game pieces are collected and stored.

13. The method for storing a four in a row according to claim 12, wherein in a case that the game piece tray is stored in the storage trough, the sealing member is inserted into the slot again for storage.

14. The method for storing a four in a row according to claim 11, wherein in a case that the game piece tray is locked, the game piece tray is pushed to rotate toward the connector, and the rotating bar that rotates inserts the plug into the plug hole of the connector, so that the game piece tray is stored in the storage trough.

15. The method for storing a four in a row according to claim 14, wherein in a case that the game piece tray is locked, the rotating bar is located in front of the sealing member, so that the sealing member is also limited.

* * * * *